US011125078B2

(12) United States Patent
Joseph et al.

(10) Patent No.: US 11,125,078 B2
(45) Date of Patent: Sep. 21, 2021

(54) FEEDBACK SIGNALING FROM DOWNHOLE TOOLS

(71) Applicant: HALLIBURTON ENERGY SERVICES, INC., Houston, TX (US)

(72) Inventors: Joseph Chakkungal Joseph, Aberdeenshire (GB); Michael John Christie, Aberdeenshire (GB)

(73) Assignee: Halliburton Energy Services, Inc., Houston, TX (US)

( * ) Notice: Subject to any disclaimer, the term of this patent is extended or adjusted under 35 U.S.C. 154(b) by 517 days.

(21) Appl. No.: 16/096,600

(22) PCT Filed: Dec. 29, 2017

(86) PCT No.: PCT/US2017/068918
§ 371 (c)(1),
(2) Date: Oct. 25, 2018

(87) PCT Pub. No.: WO2019/132969
PCT Pub. Date: Jul. 4, 2019

(65) Prior Publication Data

US 2021/0231007 A1 Jul. 29, 2021

(51) Int. Cl.
*E21B 47/00* (2012.01)
*E21B 47/14* (2006.01)
*E21B 34/06* (2006.01)

(52) U.S. Cl.
CPC ..... *E21B 47/14* (2013.01); *E21B 34/06* (2013.01)

(58) Field of Classification Search
CPC ..... E21B 47/14; E21B 47/12; E21B 47/16; E21B 47/18; E21B 34/04
See application file for complete search history.

(56) References Cited

U.S. PATENT DOCUMENTS 4,207,619 A * 6/1980 Klaveness ..... G01V 1/42 367/36
4,866,680 A * 9/1989 Scherbatskoy ..... E21B 47/18 367/83

(Continued)

FOREIGN PATENT DOCUMENTS

EP 2310627 4/2011
WO 2004001352 12/2003

OTHER PUBLICATIONS

International Patent Application No. PCT/US2017/068918 , International Search Report and Written Opinion, dated Sep. 20, 2018, 18 pages.

*Primary Examiner* — Ojiako K Nwugo
(74) *Attorney, Agent, or Firm* — Kilpatrick Townsend & Stockton LLP

(57) ABSTRACT

Aspects of the present disclosure relate to a downhole device including an actuator which has a primary purpose to operate the device while also having a secondary purpose to induce controlled pulses into a downhole environment at a first location for detection at a second location. A control package can be connected to the actuator. The control package is operable to detect a trigger event and control the actuator to cause the controlled pulses in the downhole environment in response. In some aspects, the trigger event is the reception of a command sent to the downhole device from the surface and the controlled pulses serve to provide a feedback signal receivable at the surface.

20 Claims, 7 Drawing Sheets

(56) References Cited

U.S. PATENT DOCUMENTS

| | | | | |
|---|---|---|---|---|
| 6,384,738 | B1 * | 5/2002 | Carstensen | E21B 43/11852 340/854.3 |
| 6,795,373 | B1 * | 9/2004 | Aronstam | G01V 1/133 367/85 |
| 8,225,868 | B2 | 7/2012 | Morley et al. | |
| 8,416,098 | B2 | 4/2013 | Garcia-osuna et al. | |
| 9,050,628 | B2 | 6/2015 | Lautzenhiser et al. | |
| 9,063,242 | B2 | 6/2015 | Swett et al. | |
| 10,221,653 | B2 * | 3/2019 | Walton | E21B 47/13 |
| 2002/0057211 | A1 | 5/2002 | Tubel et al. | |
| 2005/0270904 | A1 * | 12/2005 | Finnestad | G01S 7/003 367/83 |
| 2006/0033637 | A1 * | 2/2006 | Hall | E21B 47/12 340/853.1 |
| 2007/0017672 | A1 | 1/2007 | Kayadarma | |
| 2007/0056745 | A1 * | 3/2007 | Contant | E21B 47/18 166/382 |
| 2007/0194947 | A1 * | 8/2007 | Huang | E21B 47/14 340/854.3 |
| 2011/0164468 | A1 | 7/2011 | Robbins et al. | |
| 2015/0354350 | A1 | 12/2015 | Joseph et al. | |
| 2016/0333670 | A1 * | 11/2016 | Tegeler | H02M 7/219 |
| 2017/0051609 | A1 | 2/2017 | Foster et al. | |
| 2017/0130558 | A1 * | 5/2017 | Walton | E21B 34/14 |
| 2017/0211353 | A1 * | 7/2017 | Canning | E21B 47/12 |
| 2018/0363456 | A1 * | 12/2018 | Roberson | E21B 47/13 |

* cited by examiner

FEEDBACK SIGNALING FROM DOWNHOLE TOOLS

TECHNICAL FIELD

The present disclosure relates generally to devices for use in well systems. More specifically, but not by way of limitation, this disclosure relates to transmitting signals from downhole tools to the surface during well system operations.

BACKGROUND

In the oil and gas exploration and production industry, wellbore fluids that include oil or gas are recovered to surface through production tubing running down a wellbore that is drilled from surface. Various downhole tools can be used during drilling, stimulation, or production operations relative to the wellbore. Some of these tools can be activated by inducing changes at the surface of the wellbore, such as changes in pressure or changes in temperature. As a more specific example, a pressure pulse from the surface can be used to remotely activate a downhole valve being used in production. The state of such a valve, and hence the success of the valve actuation, can be only indirectly deduced in time by monitoring production characteristics of the wellbore.

DETAILED DESCRIPTION

Figure 1:
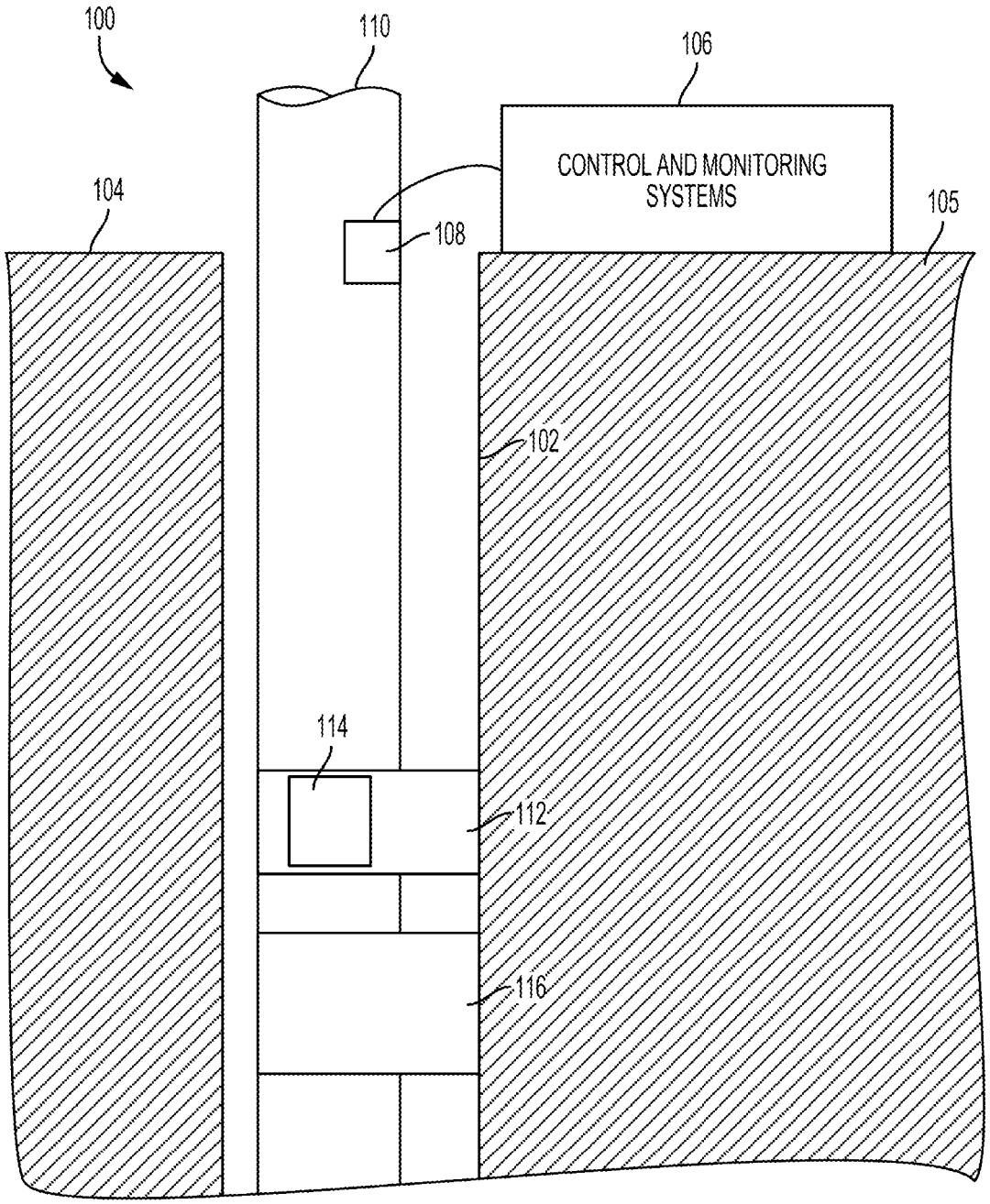
FIG. 1 is a cross-sectional view of an example of a well system that includes a downhole tool that can provide feedback signaling according to some aspects.

Certain aspects and features of the present disclosure relate to a mechanism within a downhole device for sending feedback signals from the device to the surface wirelessly. A downhole communication mechanism to do so can be added to existing devices, such as gearboxes and valve assemblies, for sending feedback signals to the surface. With such a mechanism, near real-time feedback to the surface is possible. A signal can be sent to the surface in response to any programmed trigger event. A control package that controls the signaling, detects commands being received and operates the device can also detect other external events, or internal events such as the passage of a specified amount of time. In addition to operating the downhole device, the control package can send a confirmation signal back to the surface, or send a failure signal back to the surface. A downhole device can be a downhole tool, a portion of a downhole tool, or any device that is intended to operate downhole. The term "downhole" is meant to refer to the fact that these devices and tools are intended to operate in a well. This disclosure explains a way to add a secondary function to existing downhole tools such that near real-time feedback from such remote tools can be obtained. These secondary functions can be implemented on various subsystems inside the downhole tool making them dual function subsystems.

A downhole device according to some examples can include an actuator which has a primary purpose to operate the device while also having a secondary purpose to induce controlled pulses into a downhole environment at a first location that are detected at a second location, such as at the surface of a wellbore. A control package can be connected to the actuator and control the actuator in response to detecting a trigger event to cause the controlled pulses to be outputted in the downhole environment. An example of a trigger event is receiving a command sent to the downhole device or a downhole tool associated with the downhole device from the surface. In this example, the controlled pulses can provide a feedback signal that is received at the surface.

Remote open close technology (ROCT) tools use pressure generated at the surface for remote activation. One such device that is used with such tools is a "diverter." A diverter in this context is a valve that is used to direct fluid from a hydraulic pump that is then used to operate another device, for example a larger valve. Such downhole devices operate in an open-loop mode since there is no feedback from the devices. Whether the device operated as desired and expected when activated from the surface is typically determined only indirectly and only at a later time by observing characteristics of well system operation. A mechanism according to some examples can provide feedback signals that indicate a status of operation for the device without requiring characteristics of the well system operation to be observed at a later time.

Illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 illustrates a system 100 for wirelessly communicating a signal from a downhole tool at a first location in a wellbore 102 to a second location. In this example, the second location is the surface 104 of subterranean formation 105. Control and monitoring systems 106 at a surface location are connected to a transducer 108. In the example of FIG. 1, transducer 108 is an accelerometer or hydrophone. Transducer 108 is mounted in or on production tubing 110, which includes a column of hydrocarbons (not shown) being produced from wellbore 102. The control package described in this and the other examples shown herein is an electronics package, although in other examples the control package could be hydraulic or mechanical. Downhole devices in this example include hydraulic system 112, which includes an electronics package 114, and valve 116.

When electronics package 114 of FIG. 1 detects a trigger event, it can control hydraulic system 112 to cause an actuator (not shown) to induce controlled pulses into the downhole production environment for detection at the surface. A "downhole production environment" can include production tubing, a tool string that has been placed in the wellbore, a well casing, the column of hydrocarbons being transferred uphole inside the production tubing, or any combination of these. In this example, the controlled pulses are mechanical vibrations. Electronics package 114 can also operate or actuate the device in response to the trigger event, and the controlled pulses can be in response to either the detecting of the trigger event or the operating of the device by the electronics package. For example, the trigger event may be the receipt of a command from the surface location that is sent to hydraulic system 112 from control and monitoring system 106, either through vibrational pulses being sent downhole any other connection (not shown). A "trigger event" can be anything detected by a downhole tool that ultimately directly or indirectly causes the tool to send a signal according to the examples described herein. The controlled pulses are adapted to be detected at the surface using transducer 108. The control and monitoring system 106 can act accordingly after receiving or not receiving a feedback response. For example, if no feedback response is detected, the command can be re-issued, either automatically or by an operator. A similar process can be followed if a feedback signal indicates a failed operation attempt.

Figure 2:
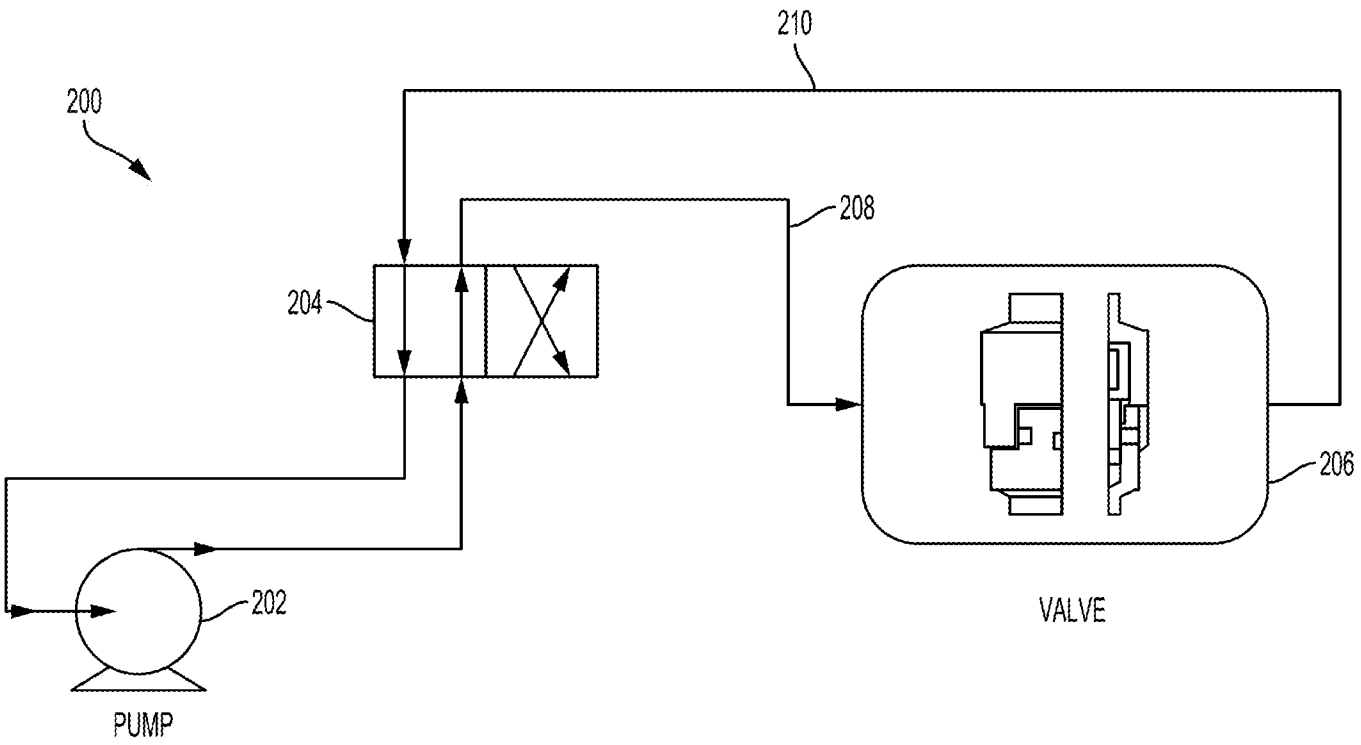
FIG. 2 is a system diagram showing a hydraulic system contained within a downhole tool that can be used to hydraulically actuate a valve within a downhole environment according to some aspects.

Returning to the example of ROCT tools, such tools can include a hydraulic system that opens a large valve by pumping hydraulic fluid in one direction, and that closes the large valve by pumping the fluid in the reverse direction. This hydraulic fluid resides in a closed loop as illustrated in FIG. 2, and the same fluid effectively flows in both directions as needed within this loop. A valve, such as the examples shown in FIGS. 1 and 2 may be deployed to prevent the flow of hydrocarbons or to re-route the flow of hydrocarbons. This Electro-Mechanical-Hydraulic system contains diverter, pump, motors and gears that can also sometimes be referred to as a "master" device while the hydraulic valve can sometimes be referred to as a "slave" valve. The "slave" valve can be deployed between the tubing and the wellbore outside the production tubing or in the production tubing.

In system 200 of FIG. 2, pump 202 is a unidirectional pump. And diverter 204 can be used to reverse the direction of the hydraulic fluid. Diverter 204 can be a cylindrical, two-port valve that rotates by about 180° to change the flow path in a closed loop. Alternatively, the diverter can operate based on linear movement. Some diverters are driven by an electric motor. However, in this example, the diverter 204 is driven by a solenoid to control the flow of the hydraulic fluid through the loop. In the state shown, the diverter is diverting hydraulic fluid to valve 206 via the path illustrated by arrow 208 to open valve 206 and route hydraulic fluid back to the pump through the path illustrated by arrow 210. When the diverter switches to its other position, the flow can be reversed, and valve 206 can close. In one example, the tools and devices are deployed as part of a tool carrier, which is in turn part of a run of production tubing.

Figure 3:
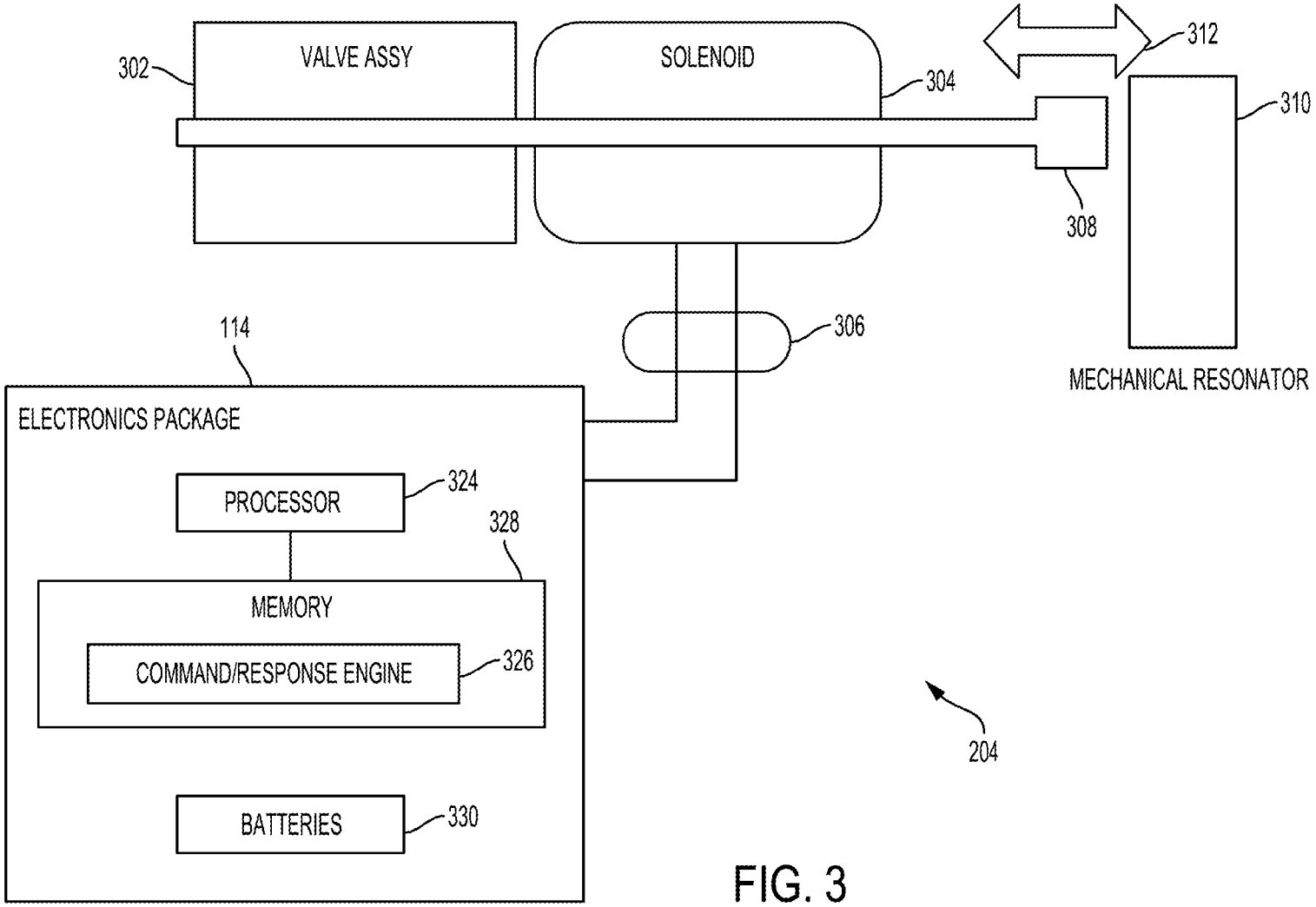
FIG. 3 is a schematic block diagram of an actuator with a built in acoustic transmitter connected to an electronics package according to some aspects.

FIG. 3 is a schematic diagram of solenoid-based diverter 204. Some possible benefits of using a solenoid valve instead of an electric motor driven diverter assembly include quick activation, with relatively low energy, the fact that there is no need for a position sensor or complex calculations to determine position, and that the device uses fewer parts, making it more reliable. An additional possible benefit is that a solenoid based diverter lends itself to implementing feedback signaling as described herein. Diverter 204 includes a valve assembly 302 and a solenoid 304. Diverter 204 also includes an input 306 to the solenoid to provide a signaling voltage. Diverter 204 also includes an actuator 308 coupled to the solenoid. In this example the rod of solenoid 304 serves as the actuator, though it could also be said that the solenoid itself is the actuator as the rod can be considered part of the solenoid. A mechanical resonator 310 operates as a tuning fork. In the example of FIG. 3, electronics package 114 provides signaling to solenoid 304 through input 306. Electronics package 114 is operable to detect trigger events and control actuator 308 using solenoid 304. In this manner, diverter 204 is able to introduce controlled pulses into the downhole production environment in response to a trigger event.

In the example of FIG. 3, the signaling voltage provided at input 306 has less magnitude than the voltage required to operate valve assembly 302. The electronics package can provide both the operating voltage and signaling voltage, possibly at different times. The signaling voltage is used to vibrate the actuator 308 as indicated by arrow 312. The operating voltage is used to move the valve assembly and may also vibrate actuator 308 at the same time. In the example of FIG. 3, the mechanical resonator 310 is struck by the actuator 308 causing controlled pulses in the downhole production environment in the form of mechanical vibrations. As an alternative to mechanical vibrations, the controlled pulses can be magnetic pulses caused directly by solenoid 304, in which case the solenoid itself serves as the actuator. Magnetic pulses can be detected by another downhole tool that is in close proximity and sent to the surface. To save power, a latching valve can be used as a diverter as well. In one example, two solenoid valves switch between two flow lines to change the direction of the fluid flow in a closed loop. It is also possible to use a single four-way solenoid valve to control the direction of the hydraulic fluid in the closed loop.

Still referring to FIG. 3, electronics package 114 includes a processor 324, a memory 328, and the batteries 330. The processor 324 can execute one or more operations related to operating the diverter and signaling as described herein. The processor 324 can execute a command/response engine 326 embodied in the memory 328 to perform operations for detecting trigger events, decoding commands, operating the diverter, determining a response to trigger events, and producing controlled pulses using solenoid 304. Non-limiting examples of the processors 324 include a Field-Programmable Gate Array ("FPGA"), an application-specific integrated circuit ("ASIC"), a microprocessor, etc. The non-volatile memory 328 may include any type of memory device that retains stored information when powered off. Non-limiting examples of the memory 328 include electrically erasable programmable read-only memory ("ROM"), flash memory, or any other type of non-volatile memory. In some aspects, at least some of the memory 328 can include a medium from which the processor 324 can read instructions. A non-transitory computer-readable medium can include electronic, optical, magnetic, or other storage devices capable of providing a processor with computer-readable instructions or other program code. Non-limiting examples of a non-transitory computer-readable medium include, but are not limited to, magnetic disk(s), memory chip(s), ROM, random-access memory ("RAM"), an ASIC, a configured processor, optical storage, and/or any other medium from which a computer processor can read instructions. The instructions may include processor-specific instructions generated by a compiler and/or an interpreter from code written in any suitable computer-programming language, including, for example, C, C++, C#, Java, Python, Perp, JavaScript, etc.

Using an actuator such as the device illustrated in FIG. 3, the moving rod of the solenoid can induce vibrations into the production tubing/hydrocarbon medium using the mechanical resonator as a tuning fork. This vibration can travel through the medium to the surface where it can be detected using transducer 108 of FIG. 1. The solenoid can be used to send a series of mechanical vibrations once the downhole tool actuation is completed as a feedback signal receivable at the surface to confirm the activation command, or in response to any other trigger event. This series of mechanical vibrations can be used to send various parameters as data packets from the device to the surface using the mechanical vibrations as a carrier wave for the data. The same method can be used to induce different vibration frequencies if more than one solenoid is used. Using multiple frequencies has the benefit of increasing the chance of getting the signal to the surface, since different downhole production environments would have different attenuations for different vibration frequencies.

Figure 4:
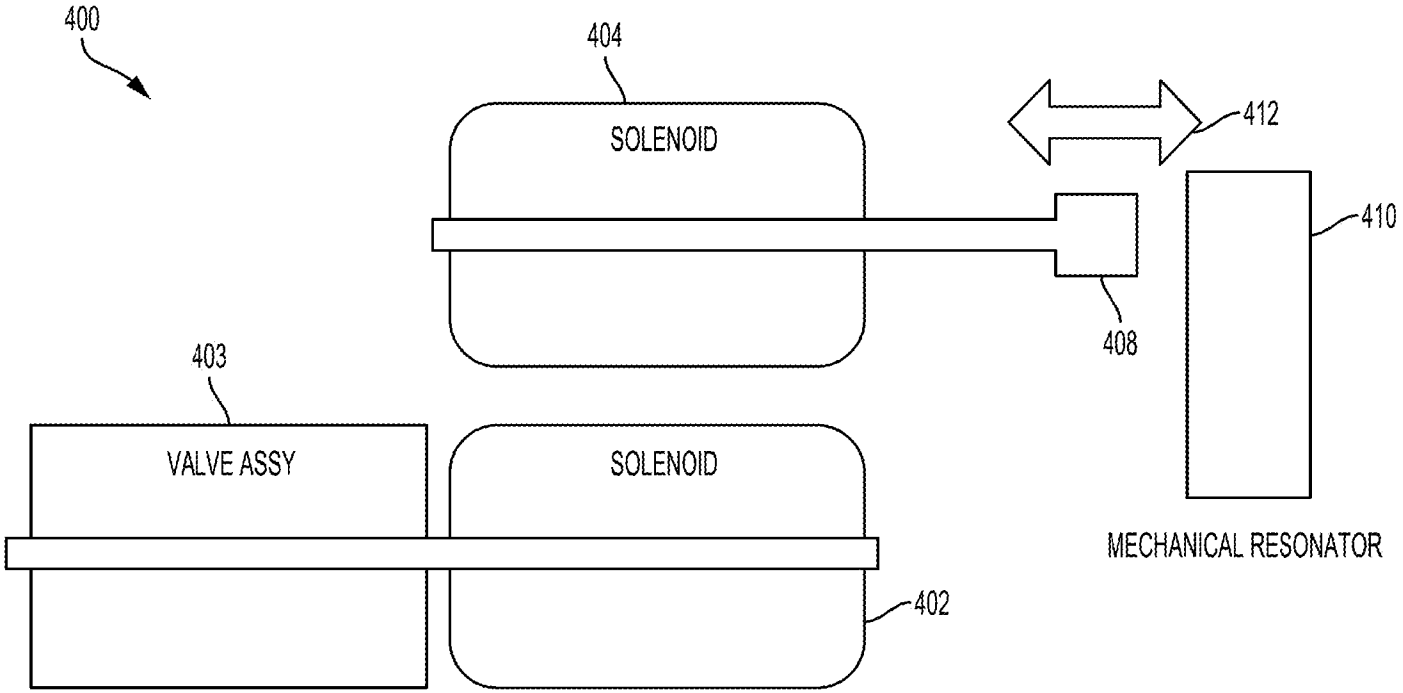
FIG. 4 is a schematic block diagram of another actuator that can provide feedback signaling according to some aspects.

The same, or different, solenoid(s) can also be used to send feedback to the surface wirelessly. FIG. 4 illustrates an example of a diverter, 400, using two solenoids. A first solenoid 402 operates valve assembly 403. A second solenoid, 404, is connected to an input for a signaling voltage as previously described. The first solenoid 402 also has a connection for an input voltage, but the connection to first solenoid 402 is mainly used to operate the diverter valve assembly 403. Diverter 400 also includes an actuator 408 coupled to solenoid 404. Mechanical resonator 410 operates as a tuning fork as previously discussed and indicated by arrow 412.

In either of the examples above, as an alternative to using the solenoid rod, actuator 308 or actuator 408 can be a hydraulic hammer coupled to the solenoid that is used to induce vibrations in the production tubing or hydrocarbons of the downhole production environment using solenoids. In one case, the solenoid valve(s) can divert hydraulic fluid from pump 202 into a chamber wherein pressure builds up and then releases in the form of a pressure pulse that causes the hammer to induce the vibrations. These vibrations can then be detected at the surface for feedback from the downhole device as previously discussed. It is also possible to use these pressure pulses to trigger other remotely operated downhole devices in the well. Thus, when controlled pulses are sent from a first location to a second location, the second location does not need to be at the surface but could be elsewhere in the well system.

Figure 5:
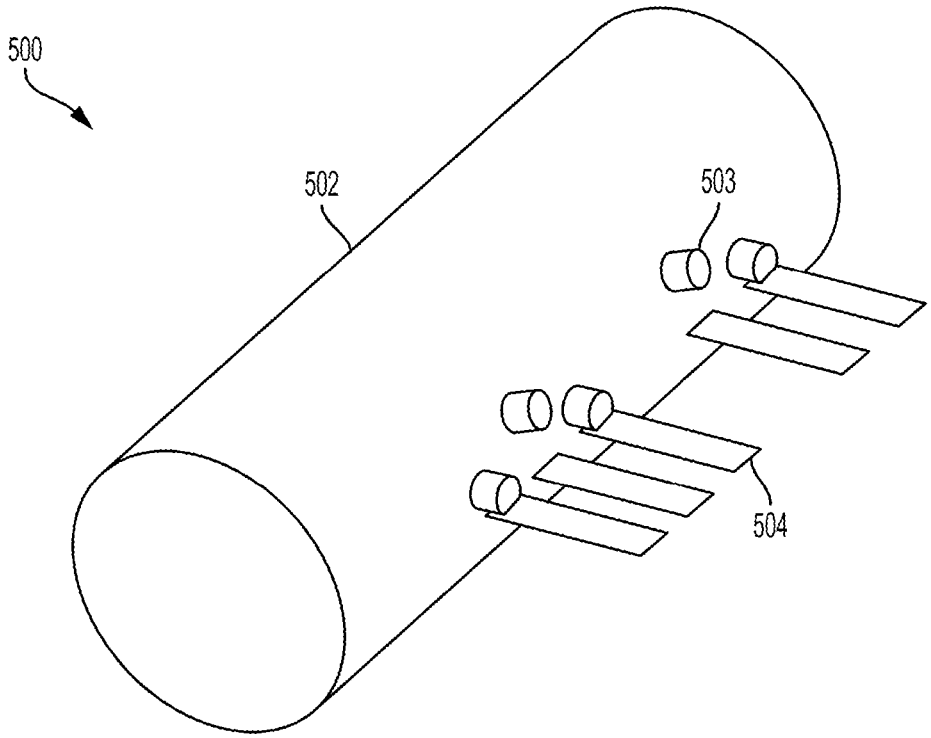
FIG. 5 is a perspective view of a rotating actuator that can provide acoustic feedback signaling according to additional aspects.

Some downhole devices and tools contain rotating parts. Such devices include motors, gearboxes, some diverters and some valves. With such parts, a signaling voltage can be used to rotate the part or a portion of the part to introduce the controlled vibrations into the downhole production environment. FIG. 5 illustrates such a downhole device. Downhole device 500 features a rotating portion 502 and protruding pins 503 that strike mechanical resonators, which take the form of strips 504, to induce vibrations in the downhole environment at multiple frequencies. The rotating portion of the device, including the pins, can be referred to as the actuator. In one example, the strips are fastened to the tool carrier (not shown). In this example, every time the rotating portion 502 of the downhole makes a full rotation, the strips 504 are struck in a specific order, resulting in a series of mechanical vibrations spread across time. These vibrations are then conducted to the surface via production tubing, hydrocarbons, or both in the same manner as previously discussed.

By adjusting the properties of the strips described above, the frequency of vibration can be selected, and by adjusting the way the pins on the rotating feature are distributed, the timing between the vibrations can be selected. The controlled pulses being used then include frequencies, timings, or both. With these two parameters (frequency, and time gap between vibrations) many different messages can be relayed back to the surface or to a second location in the well system through the downhole environment. Additionally, the frequency or time gap can provide identification of which tool sent a message when multiple tools are in use. Each tool can be operable at a unique frequency from among multiple frequencies. The properties of the strips 504 of FIG. 5 to be adjusted for frequency include shape, size and material. Note that the same type of arrangement of pins and strips can be used for signaling in a tool or downhole device in which a carrier makes a linear movement. For example, the sliding sleeve in some valves can drive a similar set of pins along a linear axis to induce mechanical vibrations.

Figure 6:
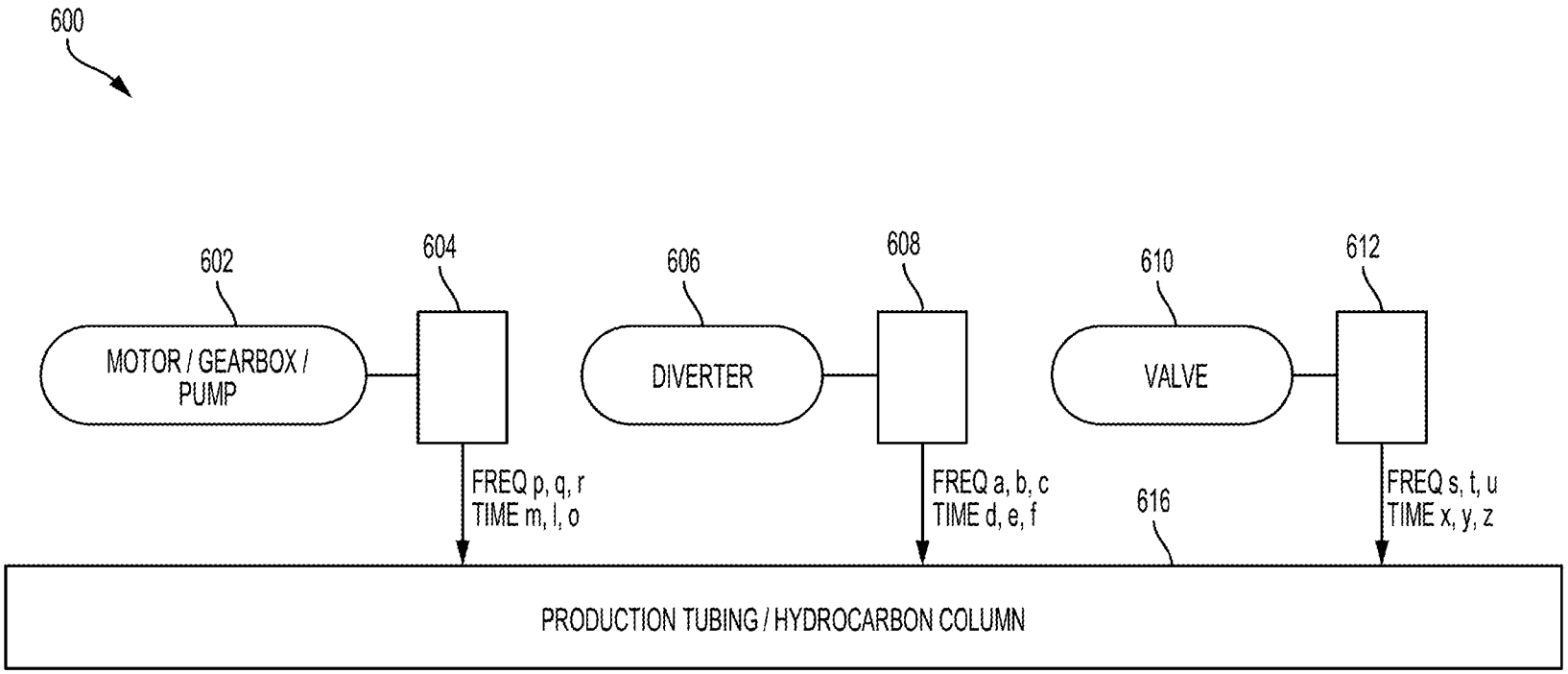
FIG. 6 is a schematic block diagram showing a number of sub-systems within a downhole tool that can provide feedback signaling being used concurrently in a downhole environment according to some aspects.

Signals from different devices in a downhole environment or different parts of the same downhole device can be distinguished by frequency, by the time gap between signaling bursts, or by both. As previously discussed, using different frequencies can increase the effectiveness when transmitting controlled pulse signals under varying well conditions. FIG. 6 illustrates a system 600 in which multiple sub-systems provide feedback signaling, with each subsystem identifying itself by using specific frequencies and time gaps. Device 602 is a pump with a motor and gearbox, which uses mechanical resonator 604 to generate signals with frequencies of p, q, r and time gaps of m, l, and o. Device 606 is a diverter which uses mechanical resonator 608 to generate signals with frequencies a, b, and c, and time gaps of d, e, and f. Device 610 is a valve, which uses mechanical resonator 612 to generate signals with frequencies s, t, and u, and time gaps x, y, and z. Signals with the aforementioned frequencies and time gaps are induced in a downhole production environment which includes production tubing 616 and a hydrocarbon column within.

Figure 7:
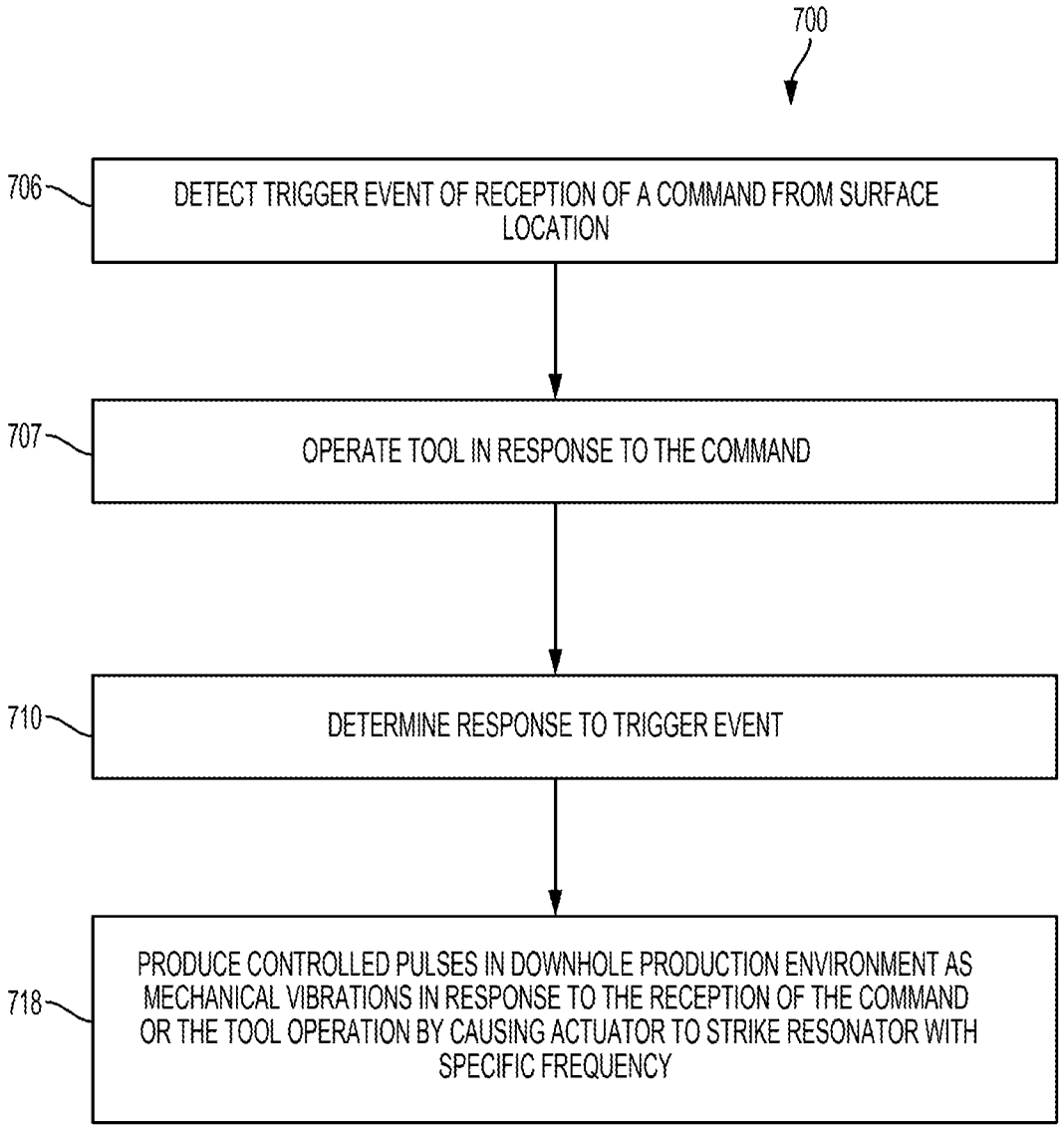
FIG. 7 is a flowchart illustrating the method of operation of an electronics package that is controlling a downhole tool according to some aspects.

FIG. 7 is a flowchart illustrating the method of operation of an electronics package that is controlling a downhole tool according to some aspects. The following operations are carried out by processor 324 using the command/response engine 326 as shown in FIG. 3. Process 700 begins at block 706, where a trigger event is detected. In this example, the trigger event is the reception of a command. At block 707, the tool is operated in response to the command. For example, if the command is to a remote open close tool, the diverter may change state, altering the direction of hydraulic fluid. This change would normally be followed by slave movement as the hydraulic fluid drives the slave valve mechanism. Other downhole devices may also be activated in a similar fashion and exhibit mechanical movement and any of these downhole devices can provide feedback using the mechanisms described herein. At block 710, the response is determined by processor 324 using the command/response engine 326 as shown in FIG. 3. At block 718, the controlled pulses are produced in the downhole production environment. Using FIG. 3 as an example, processor 324 causes solenoid 304 to move actuator 308 so that actuator 308 strikes mechanical resonator 310 in a pulsed pattern. Mechanical vibrations are thus produced in response to receiving the command or in response to the operation of the tool. Other triggers can occur because of receiving the command and multiple messages can be sent. For example, the device can send one set of pulses to indicate the command was received and another set of pulses in response to the activation of the tool, confirming a successful activation. A pulse pattern can also be sent indicating a problem. Note that the order of process blocks can vary and process blocks can be carried out simultaneously or partly simultaneously. For example, the tool can be operated later in the process relative to a feedback response being sent. Note that process blocks may also occur concurrently. For example, the feedback response may be generated as an inherent part of the tool being operated.

In some aspects, systems, devices, and methods for feedback signaling from downhole tools are provided according to one or more of the following examples:

As used below, any reference to a series of examples is to be understood as a reference to each of those examples disjunctively (e.g., "Examples 1-4" is to be understood as "Examples 1, 2, 3, or 4").

Example #1: A system including a downhole device, the downhole device including an actuator to induce controlled pulses into a downhole environment at a first location for being detected at a second location and to operate the downhole device, and a control package connected to the actuator, the control package being operable to detect a trigger event and control the actuator to cause the controlled pulses to be induced in the downhole environment in response to the trigger event.

Example #2: The system of example 1 wherein the second location is a surface location, wherein the trigger event includes receiving a command sent to the downhole device from the surface location and the controlled pulses include a feedback signal that is receivable at the surface location.

Example #3: The system of example(s) 1 or 2 wherein the controlled pulses include mechanical vibrations.

Example #4: The system of example(s) 1-3 wherein the actuator includes a solenoid, the system further comprising a mechanical resonator disposed to be activated by the solenoid to cause the mechanical vibrations.

Example #5: The system of example(s) 1-4 wherein at least one of a frequency of or a time gap in the controlled pulses provides identification of the downhole device from among a plurality of downhole devices.

Example #6: The system of example(s) 1-5 wherein the controlled pulses include pulses at a plurality of frequencies.

Example #7: The system of example(s) 1-6 wherein the controlled pulses include mechanical vibrations and the actuator includes a plurality of pins disposed to actuate a plurality of mechanical resonators, each mechanical resonator of the plurality of mechanical resonators being operable at a unique frequency from among the plurality of frequencies.

Example #8: The system of example(s) 1-7 wherein the actuator includes a solenoid and the controlled pulses comprise magnetic pulses detectable by another downhole tool that is in close proximity.

Example #9: A method including detecting a trigger event at a tool in a first location in a downhole environment of a well system, operating a downhole tool in response to the trigger event, and controlling, using a processor, an actuator to produce controlled pulses in the downhole environment in response to detecting the trigger event or to operating the downhole tool, the controlled pulses being detectable at a second location in the well system.

Example #10: The method of example 9 wherein the second location is a surface location, wherein the trigger event includes receiving a command sent to the downhole tool from the surface location and the controlled pulses include a feedback signal receivable at the surface location.

Example #11: The method of example(s) 9 or 10 wherein the controlled pulses comprise mechanical vibrations.

Example #12: The method of example(s) 9-11 wherein the actuator includes a solenoid and the controlling of the actuator with the processor further includes controlling the solenoid to strike a mechanical resonator to cause the mechanical vibrations.

Example #13: The method of example(s) 9-12 wherein the actuator is coupled to a hydraulic hammer.

Example #14: The method of example(s) 9-13 wherein the controlled pulses include pulses at a plurality of frequencies.

Example #15: The method of example(s) 9-14 wherein the controlled pulses include mechanical vibrations and the actuator comprises a plurality of pins, and wherein the controlling of the actuator with the processor further includes causing the pins to actuate a plurality of mechanical resonators, each mechanical resonator of the plurality of resonators operable at a unique frequency from among the plurality of frequencies.

Example #16: A downhole device for use in a downhole environment, the downhole device including a solenoid to operate the downhole device, an input connected to the solenoid to provide a signaling voltage to the solenoid, a mechanical resonator operable to induce controlled vibrations into the downhole environment, and an actuator coupled to the solenoid to strike the mechanical resonator in response to the signaling voltage and cause the controlled vibrations.

Example #17: The downhole device of example 16 further including an electronics package connected to the input.

Example #18: The downhole device of example(s) 16 or 17 wherein the electronics package is operable to receive a command sent to the downhole device from a surface location and the controlled vibrations include a feedback signal receivable at the surface location.

Example #19: The downhole device of example(s) 16-18 wherein the solenoid includes at least two solenoids including a first solenoid to operate the downhole device and a second solenoid connected to receive the signaling voltage from the input and operate the actuator in response to the signaling voltage.

Example #20: The downhole device of example(s) 16-19 wherein the controlled vibrations include at least one of a frequency or a time gap that identifies the downhole device from among a plurality of downhole devices.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a downhole device including an actuator to induce controlled pulses into a downhole environment at a first location for being detected at a second location and to operate the downhole device; and a control package connected to the actuator, the control package being operable to detect a trigger event and control the actuator to cause the controlled pulses to be induced in the downhole environment in response to the trigger event.

2. The system of claim 1 wherein the second location is a surface location, wherein the trigger event comprises receiving a command sent to the downhole device from the surface location and the controlled pulses comprise a feedback signal that is receivable at the surface location.

3. The system of claim 1 wherein the controlled pulses comprise mechanical vibrations.

4. The system of claim 3 wherein the actuator comprises a solenoid, the system further comprising a mechanical resonator disposed to be activated by the solenoid to cause the mechanical vibrations.

5. The system of claim 1 wherein at least one of a frequency of or a time gap in the controlled pulses provides identification of the downhole device from among a plurality of downhole devices.

6. The system of claim 1 wherein the controlled pulses comprise pulses at a plurality of frequencies.

7. The system of claim 6 wherein the controlled pulses comprise mechanical vibrations and the actuator comprises a plurality of pins disposed to actuate a plurality of mechanical resonators, each mechanical resonator of the plurality of mechanical resonators being operable at a unique frequency from among the plurality of frequencies.

8. The system of claim 1 wherein the actuator comprises a solenoid and the controlled pulses comprise magnetic pulses detectable by another downhole tool that is in close proximity.

9. A method comprising:

detecting a trigger event at a tool in a first location in a downhole environment of a well system;

operating a downhole tool in response to the trigger event; and controlling, using a processor, an actuator to produce controlled pulses in the downhole environment in response to detecting the trigger event or to operating the downhole tool, the controlled pulses being detectable at a second location in the well system.

10. The method of claim 9 wherein the second location is a surface location, wherein the trigger event comprises receiving a command sent to the downhole tool from the surface location and the controlled pulses comprise a feedback signal receivable at the surface location.

11. The method of claim 9 wherein the controlled pulses comprise mechanical vibrations.

12. The method of claim 11 wherein the actuator comprises a solenoid and the controlling of the actuator with the processor further comprises controlling the solenoid to strike a mechanical resonator to cause the mechanical vibrations.

13. The method of claim 9 wherein the actuator is coupled to a hydraulic hammer.

14. The method of claim 9 wherein the controlled pulses comprise pulses at a plurality of frequencies.

15. The method of claim 14 wherein the controlled pulses comprise mechanical vibrations and the actuator comprises a plurality of pins, and wherein the controlling of the actuator with the processor further comprises causing the pins to actuate a plurality of mechanical resonators, each mechanical resonator of the plurality of resonators operable at a unique frequency from among the plurality of frequencies.

16. A downhole device for use in a downhole environment, the downhole device comprising:

a solenoid to operate the downhole device;

an input connected to the solenoid to provide a signaling voltage to the solenoid;

a mechanical resonator operable to induce controlled vibrations into the downhole environment; and an actuator coupled to the solenoid to strike the mechanical resonator in response to the signaling voltage and cause the controlled vibrations.

17. The downhole device of claim 16 further comprising an electronics package connected to the input.

18. The downhole device of claim 17 wherein the electronics package is operable to receive a command sent to the downhole device from a surface location and the controlled vibrations comprise a feedback signal receivable at the surface location.

19. The downhole device of claim 16 wherein the solenoid comprises at least two solenoids including a first solenoid to operate the downhole device and a second solenoid connected to receive the signaling voltage from the input and operate the actuator in response to the signaling voltage.

20. The downhole device of claim 16 wherein the controlled vibrations comprise at least one of a frequency or a time gap that identifies the downhole device from among a plurality of downhole devices.

* * * * *